United States Patent [19]

Collin

[11] 4,293,076

[45] Oct. 6, 1981

[54] HANGER BAR

[76] Inventor: Herbert S. Collin, 35 Lombard St., Newton, Mass. 02158

[21] Appl. No.: 34,270

[22] Filed: Apr. 30, 1979

[51] Int. Cl.[3] ..... A47B 47/00

[52] U.S. Cl. ..... 211/124; 211/7; 211/192; 206/289; 248/70

[58] Field of Search ..... 211/124, 123, 192, 7; 248/70; 206/279, 289; 24/16 R, 20 TT, 255 SL, 263 CA

[56] References Cited

U.S. PATENT DOCUMENTS

| | | | |
|---|---|---|---|
| 712,765 | 11/1902 | Cole | 24/20 TT |
| 2,357,309 | 9/1944 | Brown et al. | 211/124 |
| 2,655,703 | 10/1953 | Flora | 24/16 R |
| 2,867,459 | 1/1959 | Brennan | 211/123 |
| 2,893,545 | 7/1959 | Garfunkel | 206/279 |
| 2,904,190 | 9/1959 | Gidwitz et al. | 211/123 |
| 3,403,787 | 10/1968 | Browning | 211/124 |
| 3,421,614 | 1/1969 | Crane | 211/123 |
| 3,458,051 | 7/1969 | Zeman et al. | 211/124 |
| 3,480,153 | 11/1969 | Collin | 211/124 |
| 3,519,139 | 7/1970 | Brennan | 211/124 |
| 3,633,760 | 1/1972 | Vosbikian | 211/124 |
| 3,748,697 | 7/1973 | Marchese et al. | 24/20 TT |
| 3,800,960 | 4/1974 | Collin | 211/124 |
| 3,902,597 | 9/1975 | Brennan | 211/124 |

FOREIGN PATENT DOCUMENTS

| | | | |
|---|---|---|---|
| 1559036 | 3/1969 | France | 24/255 SL |

*Primary Examiner*—Victor N. Sakran
*Attorney, Agent, or Firm*—Wolf, Greenfield & Sacks

[57] ABSTRACT

A clothes hanger bar for use with garment shipping cartons and portable wardrobes includes a main bar portion and integral end support members which engage and rest on the upper ends of a pair of opposite walls of the clothes container. The main bar and end support members are cold-stamped from a single sheet of metal. The juncture region of the main bar and end supports is of a special configuration which facilitates cold-stamping manufacture of the device without sacrificing strength and rigidity. The end support members are provided with an arrangement of barbs which engage the sidewalls of the carton to securely lock the hanger bar in place on the carton. A locking bar is provided to overlie the main support bar after the hangers are in place and to secure the hangers in their supported positions on the bar. Various means are disclosed for removably securing the locking bar to the main support bar structure.

15 Claims, 16 Drawing Figures

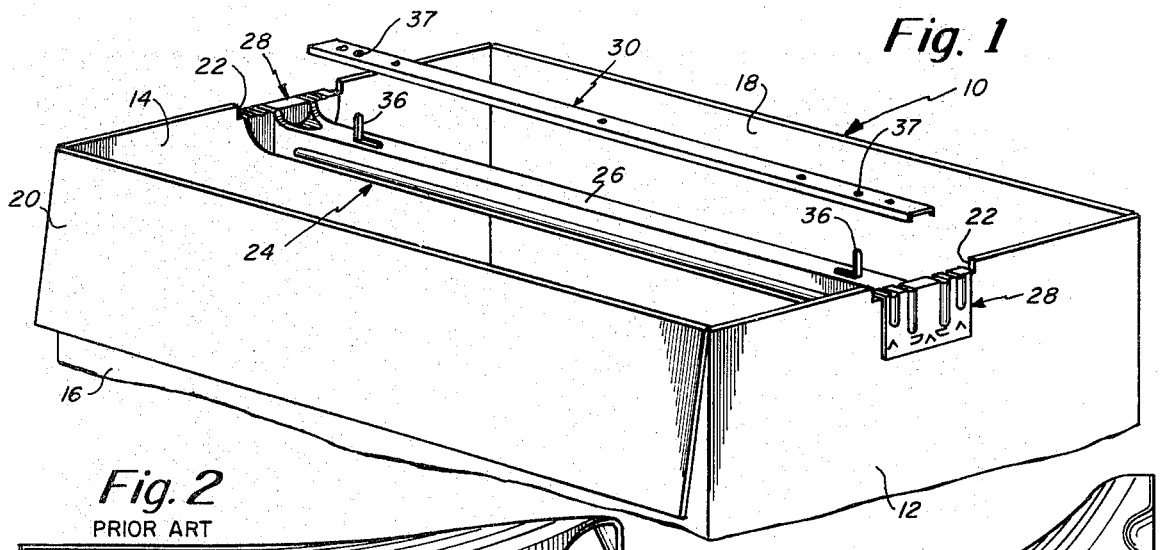
Fig. 1
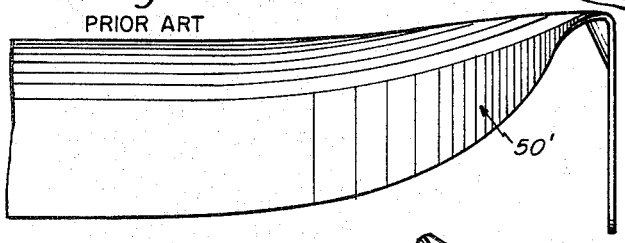
Fig. 2
PRIOR ART
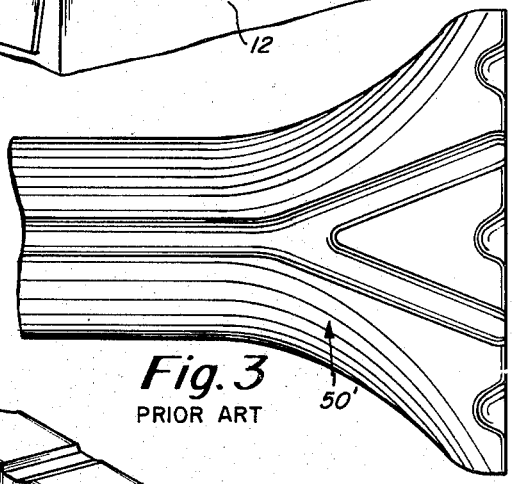
Fig. 3
PRIOR ART
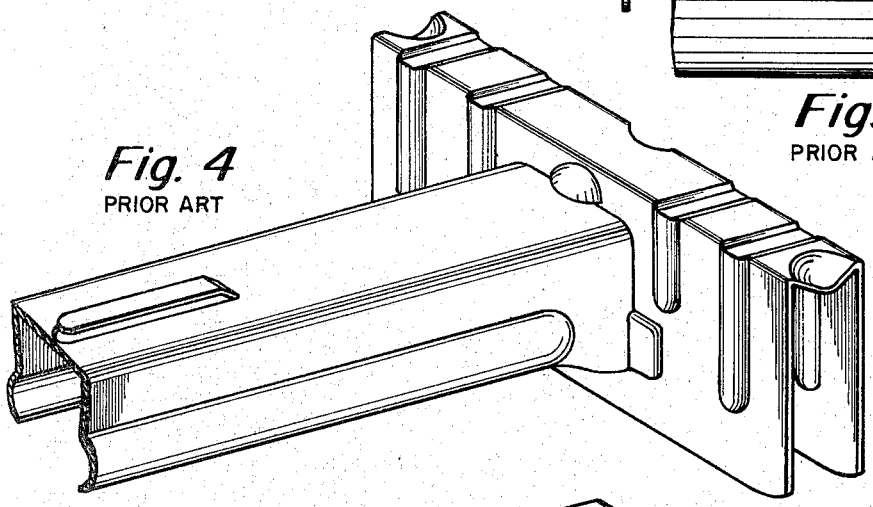
Fig. 4
PRIOR ART
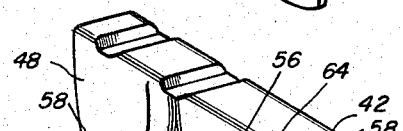

HANGER BAR

BACKGROUND OF THE INVENTION

This invention relates to improvements in commercial garment shipping cartons or portable wardrobes of the type having a hanger bar device suspended across the upper end of the container to provide a support for the garment hangers. Typically, the hanger support includes a main support bar which extends across the top of the carton and a pair of downwardly opening channel-shaped end supports by which the device is attached to the upper edge of a pair of opposite carton sidewalls. Usually some means is provided to prevent the hangers from falling off the bar.

While such hanger bars are commercially available in a wide variety of sizes and configurations, they generally can be considered as falling into two groups, namely those adapted for heavy-duty use and those suited for lightweight use. In general, the heavy-duty type of hanger bar is used by the garment industry where it is important that the garments be securely held during shipment so that they do not fall to the bottom of the carton or otherwise become disrupted which would require that the clothes be cleaned and/or pressed. In contrast, the less expensive, lightweight type of hanger bar is used almost universally in the moving and storage industry where the garment loads usually are not as substantial and where the garments, being but a small part of the shipment, often are not handled with the utmost of care. In general, the heavy-duty type of hangers are considered too expensive for the moving industry and the lightweight type of hangers are considered unsuitable for use in heavy-duty applications, such as the garment industry.

A typical characteristic of the heavy-duty type of hanger bar is that the main support bar is formed initially as a separate piece from the end support members, the main bar and end support members being subsequently secured to complete the unit. In contrast, the lightweight hanger bar often is formed in a single, integral piece in a stamping procedure which is considerably less expensive than the multi-piece construction of the heavy-duty bar.

Each type of hanger bar presents its difficulties. For example, in the three-piece type of device having separate, non-unitary end support channels, the cost of manufacture and assembly necessarily is increased because three separate pieces must be stamped and then assembled. In addition, the end support channels typically are attached to the main support bar by a number of interfitting tabs and slots which cannot provide the rigidity of a single, unitary one-piece construction. With the three-piece type of device, there always is the possibility that the end support channels may separate inadvertently. Notwithstanding these difficulties, the three-piece type of bar has been and continues to be in wide use, particularly in those environments where the bar is intended to carry a very substantial number of garments and thus be subjected to substantial loads.

The lightweight one-piece bars are of considerably thinner gauge material than the three-piece bars. For example, a typical three-piece hanger bar may be formed from sheet metal of the order of 0.040" and 0.048" thick, whereas a typical one-piece bar is formed from sheet metal of the order of 0.030" thick or less. While efforts have been made in the past to cold stamp one piece bars from heavier gauge material comparable to the gauge used in the heavy-duty three-piece bars, those efforts have not resulted in a commercially usable product. One of the difficulties has resulted from the fact that the metal in the transition region from the main support to the end support channels requires considerable stretching and drawing of metal. The heavier gauges of metal tend to crack or become very weak in the transition region. This is true even with many lightweight bars and, as a result, lightweight bars usually are formed to define a gradual and smooth transition region between the main bar and the end supports. As will be described, that results in end supports which do not effect a firm grip on the sidewalls of the container and also results in a device which cannot carry hangers near the ends of the support bar, thus reducing the number of hangers which the carton can receive. This is undesirable where maximum garment packing density is required, such as in the garment industry.

While it would be desirable to achieve the manufacturing economies of the cold stamping process in the manufacture of a heavy-duty one-piece unitary bar, those advantages have not before been achievable in a bar formed from thick material and capable of handling heavy garment loads. As a result, the one-piece bars typically have been used only where maximum packing density of garments is not required, where the possibility of the bar working loose is not critical, and where strength is not critical.

Also among the difficulties encountered with both types of presently available bars is that their end supports do not effect as firm a grip on the container sidewalls as would be desired. While this problem is more pronounced with the one-piece stamped hanger bars, it still is a problem even with the three-piece bars. An additional object of the invention is to provide improved configuration for the end support members which provides enhanced resistance to shifting of the support members on the container sidewalls.

As mentioned above, the hanger bars often are provided with a locking bar which extends over and along the top of the hanger bar to clamp the hangers onto the bar and to preclude them from falling off the bar. The present invention includes a number of improvements to such locking bars.

SUMMARY OF THE INVENTION

In accordance with the present invention, the hanger bar is cold stamped from a single elongate strip of sheet metal to form an inverted channel-shaped main bar having a top wall and a pair of downwardly extending sidewalls. The ends of the strip are simultaneously cold stamped to form the end supports, each of which is in the form of a downwardly facing, transversely extending channel. The channel-shaped end supports are intended to be placed over and engage the sidewalls of the container and each end support may itself be considered as having a top wall, an outer sidewall and an inner sidewall. The top wall of the support channel is intended to rest directly on the upper edge of the container sidewall, the outer sidewall of the end support is intended to engage the outwardly facing surface of the container sidewall and the inner sidewall of the end support is intended to engage the inwardly facing surface of the container sidewall. The sidewalls of the main support bar are connected to the inner sidewall of the end support by a deeply concave, short-radiused arcuate transition wall. The top wall of the main support bar merges into the inner sidewall of the end support through a depression or dimple formed in the transition region between the main bar top wall and the end support. The depression and top wall of the main bar cooperates with the corner transition regions to define a pair of stiffening ridges at the transition between the main bar and the end supports which greatly enhances the strength of the juncture. Thus, although the metal in the transition regions is deeply drawn and formed, the ribs more than compensate for any weakness which might otherwise result from the thinner drawn metal. The resulting joint is of comparable, if not greater, strength than that of a three-piece bar. In addition, the end supports have broad and clearly defined inner sidewalls to firmly engage the inner surface of the carton sidewalls.

In addition to the foregoing, longitudinally extending ribs preferably are stamped in the sidewalls of the main channel and may extend into the corner transitions to provide further rigidity fully along the length of the main bar as well as in the corner transition regions.

Another aspect of the invention relates to further improvements to assure that the end supports will not shift about on the container walls. In this aspect of the invention, the outer sidewalls of each end support may be provided with an array of inwardly extending barbs punched out so as to engage and dig into container sidewall in response to upward or lateral shifting motion. The barbs, however, do not interfere with initial placement of the device upon the container.

A further aspect of the invention relates to improvements in the construction of the locking bar which overlies the main support bar and secures the hangers in place. In one embodiment of the improved locking bar, the bar is provided at its ends with downwardly extending fingers which are received in slots formed at the ends of the bar. The receptive slots may be formed in the dimples formed at the end of the top wall of the main bar. In one embodiment of this aspect of the invention, the side edges of the fingers are provided with a progressively tapering saw-tooth configuration which can be pressed into secure locking engagement with the slots. In an alternate embodiment of this aspect of the invention, the fingers on the ends of the locking bar are provided with barbs extending along their top surface, and the barbs can be urged into locking engagement with the slots. In each embodiment, the locking bar may be released by urging the spring-like fingers out of the slots with a suitable tool such as a screw driver. In each of these embodiments, the locking bar enables the device to be used with wire or plastic hangers having different hook thickness.

It is among the general objects of the invention to provide a stamped, one-piece hanger bar which is suitable for use both in heavy-duty and lightweight environments.

Another object of the invention is to provide a stamped one-piece hanger bar having an integral main support bar and end support members in which the juncture between the main bar and support members is of significantly improved strength.

Another object of the invention is to provide a one-piece hanger bar of comparable strength to prior three-piece hanger bars while avoiding the disadvantages of prior one-piece bars.

A further object of the invention is to provide a one-piece hanger bar which may be stamped from heavy gauge sheet metal.

Another object of the invention is to provide a stamped one-piece hanger bar having end supports which firmly engage both the inner and outer surfaces of the container sidewalls.

A further object of the invention is to provide a hanger bar having end supports which engage the sidewalls of the container in a manner which precludes raising or lateral movement of the supports on the container sidewalls.

Still another object of the invention is to provide a hanger bar having improved locking bar structures which may be used with hangers having hooks of varying cross sections.

DESCRIPTION OF THE DRAWINGS

The foregoing and other objects and advantages of the invention will be appreciated more fully from the following further description thereof, with reference to the accompanying drawings wherein;

FIG. 1 is an illustration of the upper end of a carton having the hanger bar in place;

FIG. 2 is a side elevation of an end of a typical prior art lightweight, one-piece hanger bar;

FIG. 3 is a plan view of an end of the lightweight hanger bar shown in FIG. 2;

FIG. 4 is an illustration of a typical prior art heavy-duty hanger bar in which the end support and main bars are formed from separate pieces;

FIG. 5 is an illustration of an end of the heavy-duty stamped one-piece bar of the present invention;

DESCRIPTION OF THE PREFERRED EMBODIMENT

Figure 6:
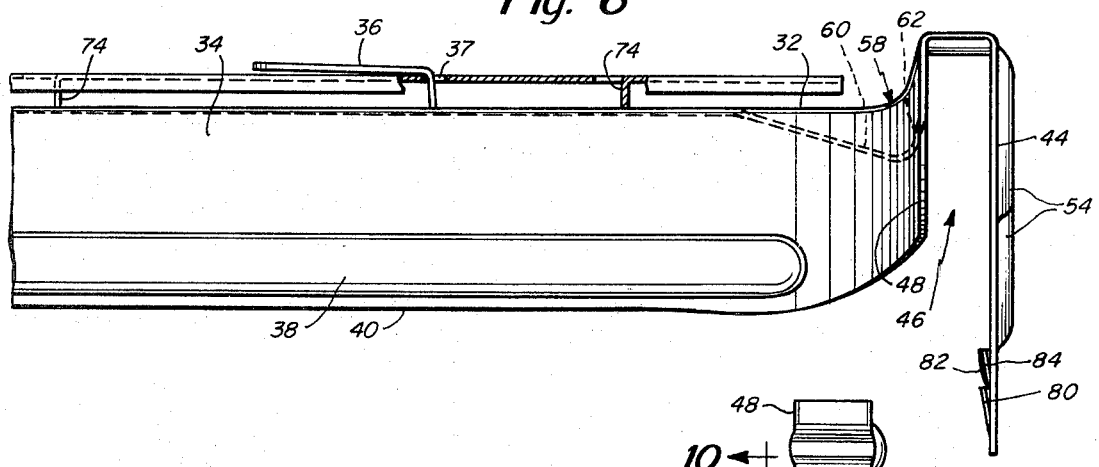
FIG. 6 is a side elevation of an end of a hanger bar formed in accordance with the present invention.
Figure 7:
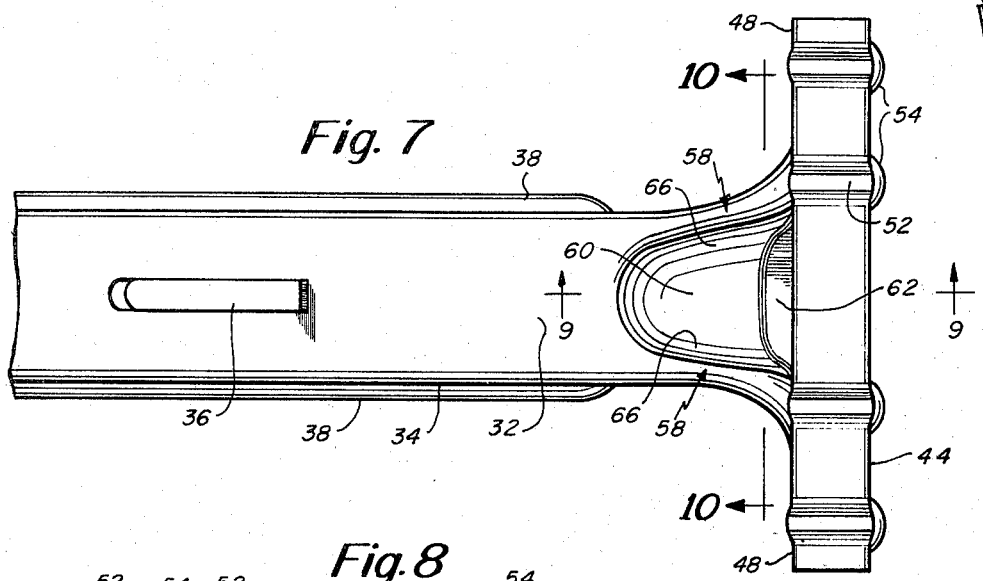
FIG. 7 is a plan view of the hanger bar shown in FIG. 6 with the locking bar removed.

FIG. 1 illustrates a container or portable wardrobe, indicated generally at 10. The container 10 is rectangular and has end walls 12, 14, sidewalls 16, 18 and a bottom wall and a number of top closure flaps 20. The container 10 typically is formed from corrugated cardboard and may be formed in any of a wide variety of suitable constructions. The end walls 12, 14 may be provided with notches 22 which receive and support the clothes hanger bar which is indicated generally at 24.

As illustrated in FIGS. 1 and 5–10, the hanger bar 24 is stamped from a single, unitary piece of sheet metal, preferably steel, of the order of 0.040″ thick. The hanger bar 24 is formed to define a main bar 26 having integral end support members 28 at each end of the main bar 26. The end supports 28 define downwardly opening channels which are placed over the upper ends of the end walls 12, 14 of the container 10 to receive and firmly engage the end walls 12, 14, thereby supporting the main bar 26 across the length of the container 10 so that the hooks of garment hangers may be suspended from and along the main bar 26. The hanger bar 24 preferably is provided with a locking bar, indicated generally at 30 which may be placed over and along the main bar 26, and secured in that position, to hold the hanger hooks firmly on the main bar 26, as will be later described.

Figure 10:
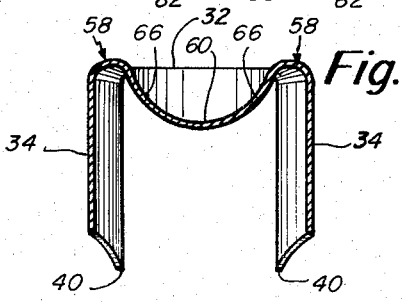
FIG. 10 is a sectional illustration of the device as seen along the line 10—10 of FIG. 7.

In accordance with the present invention, the entire hanger bar 24, including the main bar 26 and integral end support members 28 is formed from a single strip of sheet metal and is stamped into its configuration in a single stamping operation. The main bar 26 is formed into a generally downwardly opening channel-shaped configuration defining a top wall 32 and a pair of downwardly extending sidewalls 34. A pair of bendable tongues 36 are struck out from the top wall 32 of the main bar 26 and are received in openings 37 in the locking bar 30 to secure the locking bar 30 in place. In addition, a rib 38 is formed along the lower region of each of the sidewalls 34 and extends longitudinally of the main bar 26. As shown in FIGS. 6 and 10, the lower edge of the rib 38 terminates slightly above the lower edge of the sidewall 34 thereby defining a longitudinally extending bottom flange 40 along the bottom of each sidewall 34. The rib 38 and flange 40 cooperate to provide additional stiffness to the bar and serve other functions described herein.

The end support members 28 are stamped into their configuration simultaneously with the stamping of the main bar 26 and are formed to define somewhat of a channel-shaped configuration in which the channel extends transversely of the channel of the main bar 26. Thus, each end support member includes a top wall 42 and an outer sidewall 44 which extends downwardly from the top wall 42. As illustrated, the outer sidewall 44 is intended to bear against the outer surface of the associated container end wall 12, 14. The transverse channel 46 of the end support member 28 also is defined by what may be considered as inner sidewall members 48 which extend downwardly from the top wall 42 and which merge, through a transition corner region 50, with their associated main bar sidewalls 34. The inner sidewall members 48 extend substantially along a plane parallel to the outer sidewall 44 and are spaced from the outer sidewall 44 so that the width of the transverse channel 46 substantially corresponds to the thickness of the container endwall 12, 14 with which the device is to be used. When the hanger bar 24 is securely in place on a container, the container end wall will be embraced firmly between the inner sidewall members 48 and outer sidewall 44 of the end supports 28. Reinforcing grooves 52 and ribs 54 may be stamped into the top wall 42 and outer sidewall 44 of the end supports 28 to further rigidify those elements of the device.

Among the significant advantages of the present invention is that the transition region 50 between the main bar sidewalls 34 and the inner sidewall members 48 of the end supports 28, is of a sufficiently small radius so that the inner sidewall members 48 can be formed to provide a substantial area of bearing contact. In addition, by maintaining a comparatively small radius transition region 50, the effective width of the main bar 26 remains constant substantially along its full length. This is to be contrasted with the prior stamped bars which have a very large radiused, gradual transition region from the main bar sidewall to the end support. As illustrated in FIGS. 2 and 3, the prior art transition area 50 is too wide to accommodate a number of hangers at the ends of the bars. That presents problems when packing density is important, such as in the garment industry. As mentioned, the garment industry does not use the one-piece stamped hanger bar of the type shown in FIGS. 2 and 3, but instead, uses the more expensive three-piece type of bar (shown in FIG. 4) in which the end supports 28 are formed separately from the main bar 26 and are attached in separate procedure which results in a right angle juncture between the main bar and the end support.

The present invention provides a one-piece stamped bar which is capable of accepting same number of hangers as a three-piece bar, yet which is more economical in that it may be fabricated from a single blank in a single forging operation. Prior effects to make a one-piece hanger bar which satisfies the heavy-duty requirements of the garment industry have not met with success. One of the primary difficulties in trying to make a single-stamped bar has been that efforts to make a deep transition corner region 50 tend to crack or draw the metal very thin during the stamping operation. As a result, the integral connection between the main bar 26 and end supports 28 would be considerably weaker and of unreliable strength. This difficulty also results in the type of prior bar shown in FIGS. 2 and 3 in which the end support has no significant inner sidewall (corresponding to 48 of applicant's invention) and, therefore, does not result in a well defined box-receptive channel. As a result, the prior single-piece stamped devices do not effect a firm grip on both sides of the end wall of the container and can be dislodged easily.

In accordance with my invention, the foregoing difficulties are overcome by forming a dimple 56 in the top wall 32 of the main bar 26 during the forging process. This eliminates the tendency for the transition corner region 50 to crack or become unduly weakened and enables a deep short radiused region 50 to be formed. It is believed that formation of the dimple 56 has an effect on the manner in which the metal in the transition region 50 is stressed. Thus, the inclusion of the dimple 56 during the forming process enables the formation of a deep, short radiused transition corner region 50 which, in turn, enables the metal to be formed to define the inner sidewall members 48 of the end support 28. In addition, the dimple 56 also adds further strength and rigidity to the juncture between the main bar 26 and the end supports 28. By forming the dimple 56, the cross sectional configuration of the bar, in the region of the dimple, (as illustrated in FIG. 10) is somewhat M-shaped and defines a pair of double thickness ridges 58 at the upper region of the juncture between the main bar 26 and the end support 28. The double thickness ridges 58 substantially enhance the rigidity and strength of the juncture between the main bar 26 and end supports 28.

The dimple 56 may be considered as having a downwardly and outwardly inclined bottom wall 60, which merges smoothly from the main bar top wall 32, and an upwardly extending end wall 62. This end wall 62 merges into a more vertical end wall portion 64 which serves as an additional inner sidewall member which will bear against the inner surface of the container end wall 12, 14. The sides of the dimple 56 are defined by dimple sidewall segments 66 which cooperate with the transition corner regions 50 to define the double thickness ridges 58 described above.

Thus, the dimple 56 serves a number of purposes. It enables the connective skirt or transition region 50 to be drawn into a compact, short radius configuration which, in turn, enables full garment packing density as well as providing a number of substantial inner sidewall surfaces 48, 64 to bear against the inner surface of the contaner end walls 12, 14, and, in addition, significantly increases the strength and rigidity of the main bar - end support juncture by providing the double thickness ridges 58.

Yet another advantage of the present invention is that the transverse length of the channel-shaped end supports is materially greater than has been achievable with prior one-piece, single-stamped hanger bars. It is desirable that the length of each of the end supports 28 be as large as possible so that the load may be spread over a longer segment of the carton end wall. However, in one piece, single-stamped bars fabricated from a strip of uniform width steel, the length of the end support member necessarily is limited by the width of the strip stock from which the bar is stamped. The width of the strip stock, in turn, is limited by the maximum dimensions of the main bar 26 from which the hangers will be suspended. The reason for this is that garment hangers have hooks generally of uniform dimensions and, as a practical matter, the width of the main bar top wall 32 cannot be greater than $1\frac{1}{8}$ or $1\frac{1}{4}$ inches if it is to properly accommodate the garment hangers. Similarly, the downwardly extending main bar sidewalls 34 cannot be too deep as they would interfere with proper hanging of the garment hangers. Thus, there is a practical limit to the width of the strip of sheet metal from which the device can be stamped. For example, commercially employed one-piece stamped hanger bars typically have been formed from comparatively thin sheet stock, three inches wide, thus limiting the maximum length of the end support members 28 to three inches. While such a comparatively small end support length may be marginally adequate for lightweight applications, such as the moving industry it is inadequate for heavy duty applications, such as those required by the garment industry, where it is preferred that the end support members be at least four inches long. This is but an additional reason why the presently available one-piece bars have not found favor with the garment industry. In this regard, it should be noted that the three-piece bar which is employed by the garment industry has end support members which are formed separately from the main bar and which, therefore, can be made in any desirable length, unrestricted by the width of the stock material from which the main bar is made.

In the present invention, the bar may be formed from four inch wide sheet stock which results in end supports 28 having a length satisfactory for heavy duty use. The cross sectional dimensions of the main bar 26 may be maintained within the tolerances required to accept conventional hanger hooks by forming the main bar top wall 32 to have a conventional width of $1\frac{1}{8}$ and $1\frac{1}{4}$ inches. The effective depth of the main bar sidewalls 34 is limited by forming the longitudinally extending rib 38 so that the bottom edge of the flange 40 is not so low that it would interfere with proper placement of the hanger. Thus, the present invention provides a hanger bar which meets the requirements for use in the garment industry, but which avoids the necessity and expense of forming the device from multiple pieces which must be assembled at obviously greater difficulty and expense than is achievable with the integral one stamped bar.

The locking bar 30 similarly may be stamped into a channel-shaped strip. A pair of holes 37 are formed along the length of the locking bar to receive the tongues 36 struck from the main bar top wall 32. In use, the hangers are suspended from the main bar with the tongues 36 in their raised configuration. After all the hangers are in place, the locking bar is positioned over the main bar with its tongues extending through the holes 37 and the tongues then are bent over the locking bar to secure it in place (FIG. 6). The locking bar thus assures that the hangers will not separate from the main bar. In addition, the locking bar may be provided with means to prevent the hangers from shifting laterally along the support bar. To this end, a plurality of downwardly extending fingers 74, may be struck out from the bar at locations spaced longitudinally along the bar. The fingers 74 preferably should extend downwardly from the locking bar approximately $\frac{1}{4}$ of an inch so that they will be in proximity to the main bar top wall 32 when the locking bar is in position. When the bar is in position, the downwardly extending fingers 74 will embrace groups of hanger hooks and will preclude them from shifting laterally.

Figure 8:
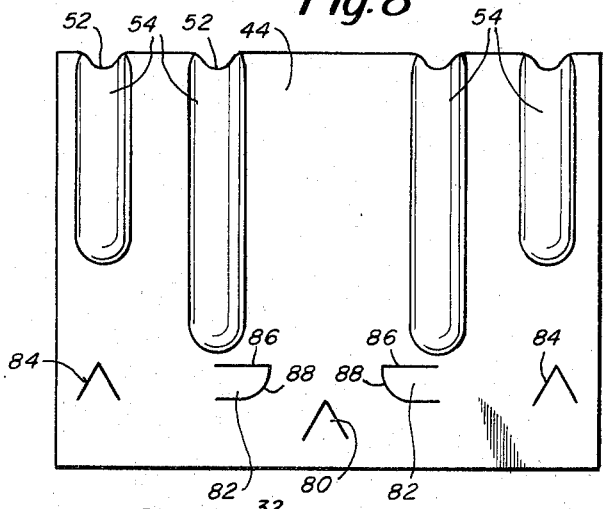
FIG. 8 is an end view of the end support member shown in FIG. 6.
Figure 9:
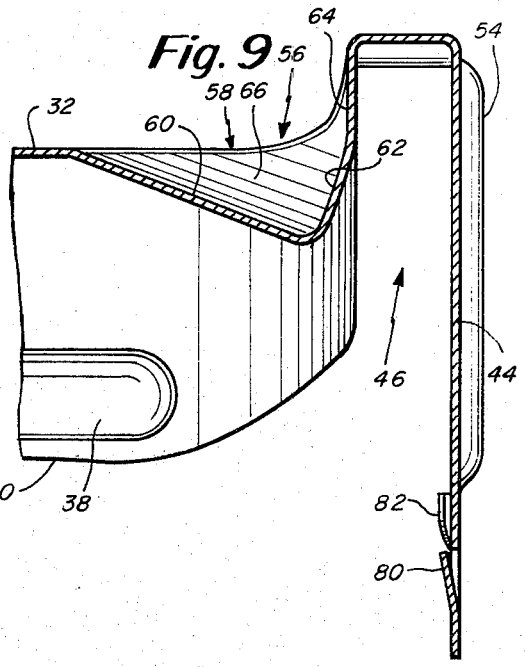
FIG. 9 is a sectional elevation of the device as seen along the line 9—9 of FIG. 7.

While the invention has been described in connection with a container having notches 22 in its walls to receive the end supports 28, it nevertheless may be desirable to provide means on the end supports to secure the bar in place with respect to the sidewalls, for example, if used with a container which has no notches. To this end, and as illustrated in FIGS. 8 and 9, the outer sidewalls 44 of the end supports 28 may be provided with a number of struck-out barbs which are intended to dig into and positively engage the outer surfaces of the container. Three barbs may be provided, including a middle barb 80 and a pair of side barbs 82. The middle barb 80 is of generally triangular configuration and projects upwardly and inwardly so that it may engage the container wall and resist upward movement of the end support. The side barbs 82 are formed to have a generally straight top edge 86 and a curved lower edge 88, the edges 86, 88 meeting at a sharp point. The side barbs 82 are spaced vertically from the center barb 80 and are arranged so that their points face each other. The smoothly curved lower edge 88 of the side barbs 82, 84 and the upwardly and inwardly extending direction of the central barb 80 are such that they will not tear into or significantly dig into the container surface when the end support 28 is attached to the container. However, any upward or lateral shifting motion is resisted by engagement of one or more of the barbs with the container wall. If desired, a pair of additional barbs 84 may be formed in the outer sidewall 44 of the end supports, in proximity to the laterally disposed edges of the outer sidewall 44, as shown in FIG. 8. The inclusion of such laterally disposed barbs adds further stability for the device. The additional barbs 84, when employed, preferably are disposed approximately at the level of the side barbs 82.

Figure 11:
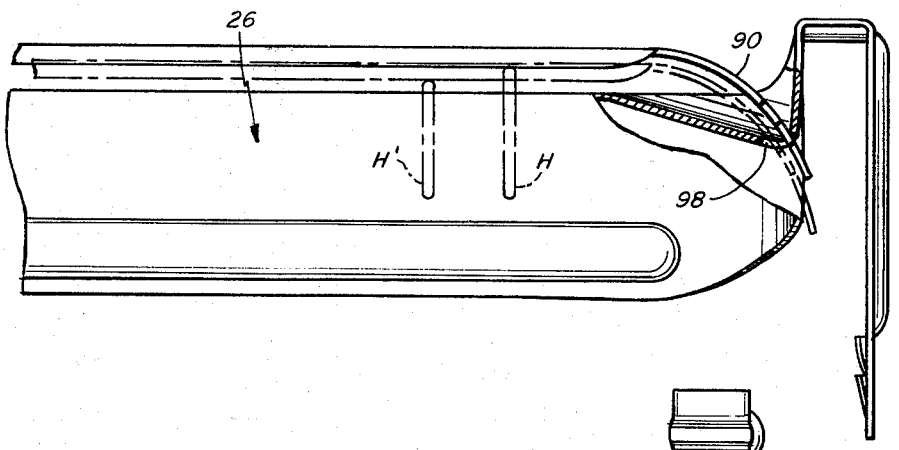
FIG. 11 is a side elevation of a hanger bar having a modified form of locking bar.
Figure 12:
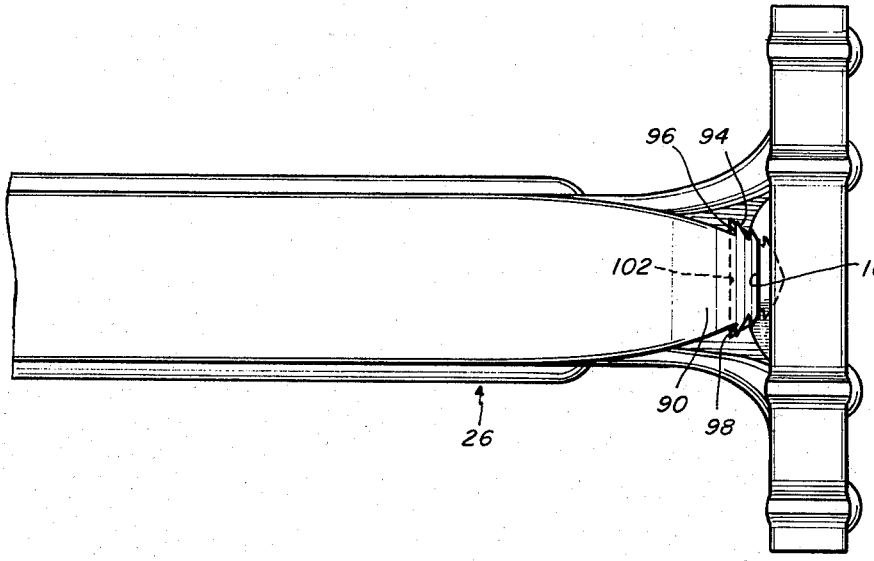
FIG. 12 ia a plan view of the device illustrated in FIG. 11.
Figure 13:
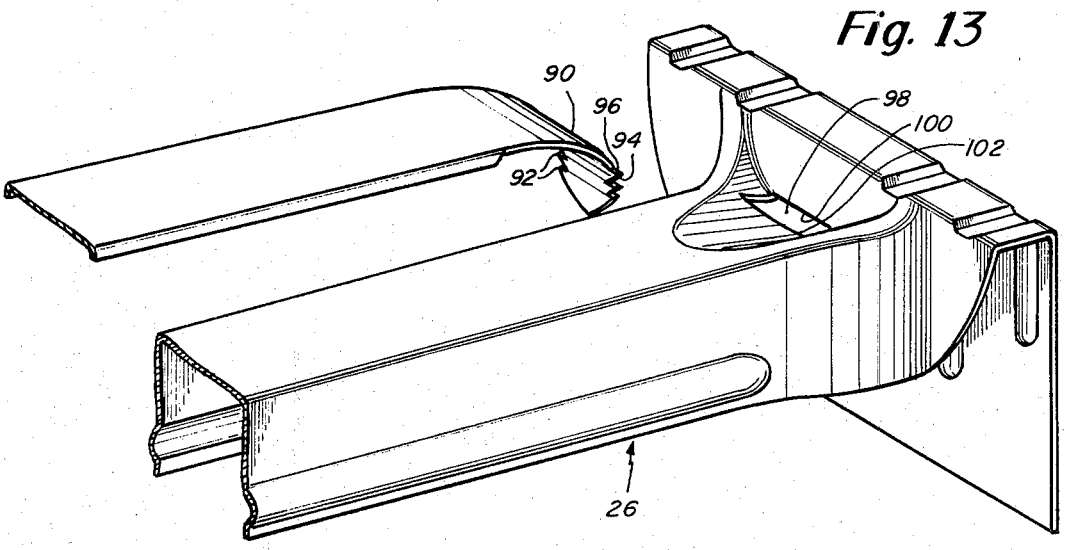
FIG. 13 is an illustration of the locking bar shown in FIGS. 11 and 12, separated from the hanger bar.

FIGS. 11–13 illustrate a modified form of locking bar which omits the use of the tongues 36 and holes 37 described above. In this embodiment, the locking bar is self-attaching to the hanger bar by forcing the ends of the locking bar downwardly toward the main bar 26. In this embodiment the locking bar is provided at each of its ends with a downwardly curved finger 90. The width of each finger 90 tapers progressively toward its end and the side edges of the finger are formed with a plurality of sawtooth-like barbs 92. Each barb 92 is defined by a wedging edge 94 and a locking edge 96. The main bar 26 is formed with a slot 98 in each of its dimples 56 so it can be receptive to receive the barbed fingers 90. As shown in FIGS. 12 and 13, the slot 98 extends transversely of the main bar and is shorter along its outer edge 100 than at its inner edge 102. The slot may be of trapezoidal configuration. This embodiment of the locking bar is secured to the main bar 26 by simply inserting and urging the ends of the fingers 90 into the slots 98 to force the barbed fingers 98 to the slots 98. The slots 98 and barb fingers 90 are dimensioned so that the width of the barbs can pass through the wider inner edge 100 of the slot 98, the shorter, outer end of the slot 98 being intended to engage the barbs and preclude the fingers from being separated. The fingers 90 are resilient and flexible so that they can flex as they are inserted into the slots 98 and, when inserted, they will return to their more outwardly disposed relaxed position in which the locking edges 96 of the barbs 92 will engage and interlock with the shorter side of the slot 98. The bar may be removed by wedging a screw driver or similar tool between the finger and the slot 98 to urge the barbed finger toward the wider, inner edge of the slot 98 which frees the barb 92 from the slot 98. This embodiment of the locking bar enables the same bar to be used with hangers having hooks of different thicknesses. For example, wire hangers typically have a thinner hook cross section than do plastic hangers. Depending on the extent to which the fingers 90 are urged into their receptive slots 98, the locking bar can be bought to bear firmly against a wide variety of hangers H, H' having varying hook thicknesses as suggested in solid and phantom in FIG. 11.

Figure 14:
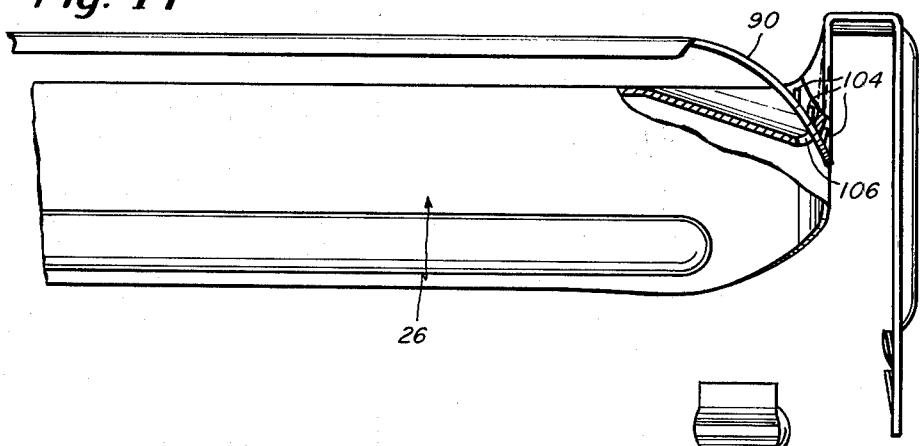
FIG. 14 is a side elevation of another embodiment of an improved locking bar.
Figure 15:
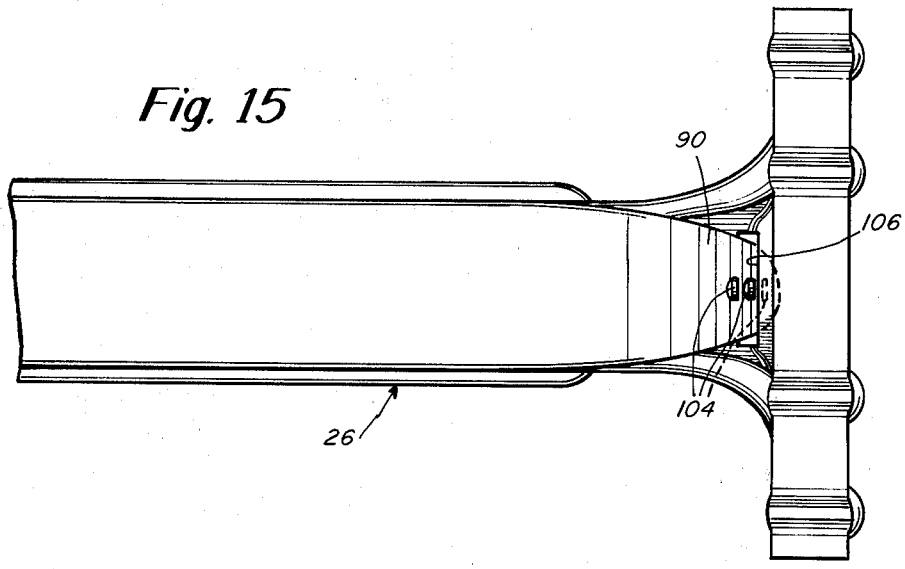
FIG. 15 is a plan view of the device illustrated in FIG. 14.
Figure 16:
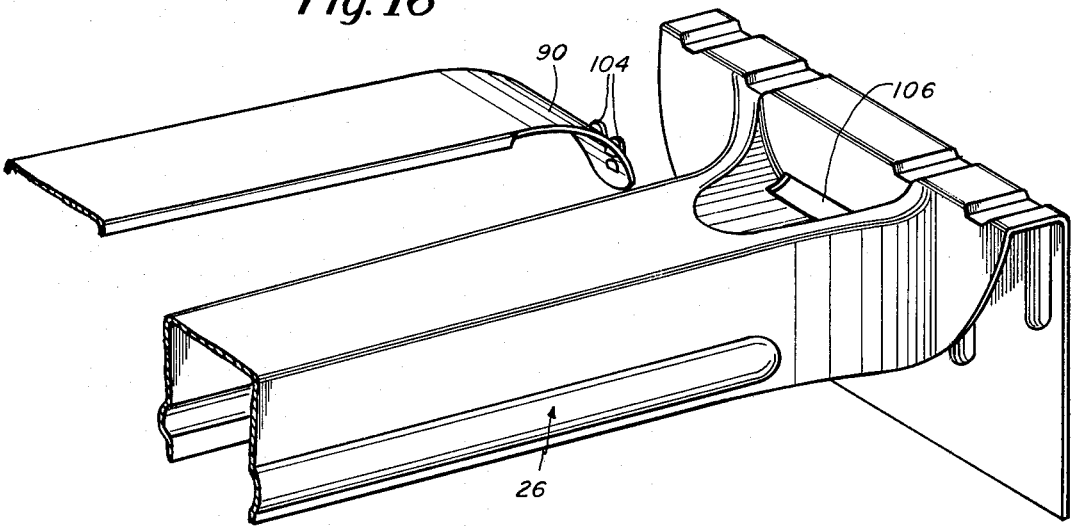
FIG. 16 is an illustration of the locking bar shown in FIGS. 14 and 15, separated from the hanger bar.

FIGS. 14–16 show another embodiment of the locking bar in which a series of barbs 104 are struck from the face of the finger 90. A plurality of such barbs are formed on each finger, and the barbs 104 project upwardly from the upper surface of the fingers 90. This embodiment of the locking bar may be inserted into a suitable formed slot 106 which, when the fingers 90 are pressed into the slot 106 will cause one of the barbs to engage the slot to secure the locking bar in place. Removal in this embodiment is similar to that in the previously described embodiment, by inserting a screw driver or similar tool to resiliently bend the finger so that the barbs 104 can clear the slot 106.

Thus, it will be appreciated that I have provided an improved garment hanger device having features suitable for use in the garment industry yet which is fabricated in a stamped, one-piece integral construction and which avoids the difficulties and expense of the three-piece type of bar which has been used substantially universally in the garment industry. However, while the bar provides an effective substitute for the three-piece garment industry bar, it is equally usable and is sufficiently inexpensive in its manufacture so that it may be used in other environments, such as the moving industry.

It should be understood, however, that the foregoing description of the invention is intended merely to be illustrative thereof, and other embodiments and modifications may be apparent to those skilled in the art without departing from its spirit.

Having thus described the invention, what I desire to claim and secure by Letters Patent is:

1. A garment hanger bar for a portable clothes container or the like comprising:

an elongate channel-shaped main bar having a top wall and a pair of downwardly extending sidewalls;

an end support formed at each end of and integrally with the main bar, each end support defining a downwardly opening channel which extends along a direction transverse to the longitudinal dimension of the main bar, each end support being adapted to receive and rest on the upper end of a wall of the container;

each end support having a top wall and a downwardly extending outer sidewall adapted to face the outer surface of the container wall;

each end support having inner sidewall segments which extend downwardly from the top wall of the end support, the inner sidewall segments being integrally connected to and forming a continuation of the sidewalls of the main bar;

said inner sidewall segments having at least portions lying in a plane substantially parallel to that of the outer sidewall of the end support, said inner sidewall members being adapted to face the inner wall surface of the container;

a depression formed in the top wall of the main bar adjacent its juncture with the end support;

said main bar and end support being formed from a single unitary sheet of metal.

2. A garment hanger bar as defined in claim 1 further comprising:

each of the inner sidewall segments being generally triangular in shape.

3. A garment hanger bar as defined in claim 1 further comprising:

the cross sectional configuration of the main bar, in the region of the depression being generally M-shaped and defining a pair of reinforcing ridges extending along the top wall of the main bar to the end supports.

4. A garment hanger bar as defined in claim 3 further comprising:

said depression having a bottom wall which extends from the top wall of the main bar downwardly and outwardly toward the end support, the bottom wall terminating in an upwardly extending end wall, at least the upper portion of the end wall lying in a plane substantially parallel to the outer sidewall of the end support and in substantially the same plane as said inner sidewall members, thereby to define an intermediate inner sidewall segment adapted to face the inner wall surface of the container.

5. A garment hanger bar as defined in claim 4 wherein the top wall of the main bar extends substantially along a plane which is below that of the top wall of the end supports.

6. A garment hanger bar as defined in claim 1 further comprising:

each of the downwardly extending sidewalls of the main bar being formed to include an elongate, longitudinally extending rib, the lower edge of the rib terminating above the lower edge of its associated sidewall thereby to define a longitudinally extending flange along the lowermost edge of each main bar sidewall.

7. A garment hanger bar as defined in claim 1 further comprising:

a locking bar detachably connectable to the hanger bar for retaining garment hangers on the hanger bar.

8. A locking bar for use with a garment hanger bar, the hanger bar including an elongate main bar and an end support at each end of the main bar, said locking bar comprising:

an elongate strip of metal of a length substantially equal to the length of the main bar;

means for detachably connecting the locking bar to the upper surface of the main bar and in close proximity to the main bar;

the locking bar having a plurality of fingers struck out from the locking bar and extending downwardly therefrom, there being a plurality of such locking fingers longitudinally spaced along the locking bar, each of the fingers extending downwardly into close proximity to the upper surface of the main bar when the locking bar is attached to the main bar thereby to define a plurality of enclosed spaces between each pair of fingers to retain the hangers and prevent them from shifting laterally along the main bar.

9. A method for forming a one-piece hanger bar having a main bar and contiguous end supports comprising:

cold stamping an elongate strip of metal to define a main bar in the form of a downwardly extending channel having a top wall and a pair of downwardly extending sidewalls and simultaneously cold stamping the end supports from the ends of the strip of material to form a downwardly opening channel configuration having a top wall, an outer sidewall and inner sidewall members, with the inner sidewall members being connected in a single, integral piece to the top wall of the end support and to the sidewall of the main support; and simultaneously forming a depression at the juncture of the top wall of the main bar and the end support thereby to facilitate formation of a short radius transition region between the sidewalls of the main bar and the inner sidewalls of the end support whereby the inner sidewalls of the end support may lie in a plane which substantially parallels the outer sidewall of the end support.

10. A hanger bar and locking bar for a garment container comprising:

an elongate channel-shaped main bar having a top wall and a pair of downwardly extending sidewalls;

an end support secured to each end of the main bar, each end support defining a downwardly opening channel which extends along a direction transverse to the longitudinal dimensions of the main bar, each end support being adapted to receive and rest on the upper end of a wall of the container;

a locking bar adapted to be detachably connected to the main bar, said locking bar comprising an elongate strip of metal having a downwardly extending, resilient finger formed at each end thereof;

a plurality of barbs formed at longitudinally spaced locations along the fingers;

each end of the hanger bar having an aperture formed therein to receive the fingers of the locking bar, said apertures, fingers and barbs being constructed and arranged so as to require the fingers to be flexed inwardly in order to permit the barbs to clear the aperture, said fingers being of resilient construction so that after insertion of the fingers into the aperture, the fingers will be resiliently biased outwardly to cause the barbs to engage the apertures and thereby lock the locking bar to the garment hanger;

whereby the spacing between the locking bar and the main body of the hanger bar may be determined by the extent to which the barbs are urged into the apertures.

11. A garment hanger bar and locking bar as defined in claim 10 further comprising:

said barbs being struck upwardly and outwardly from the fingers and being adapted to engage the outermost edge of the aperture.

12. A hanger bar and locking bar as defined in claim 10 further comprising:

said barbs being formed along the side edges of each of the fingers and being of sawtooth configuration;

said aperture being wider at its outer extremity than at its inner extremity, the wider portion of the aperture being of width sufficient to enable all the barbs to pass freely therethrough and the narrower end of the aperture being sufficiently small to engage any of the barbs.

13. A device as defined in claim 12 wherein the aperture is trapezoidal.

14. A garment hanger bar for a portable clothes container or the like comprising:

an elongate channel-shaped main bar;

an end support formed at each end of the main bar, each end support defining a downwardly opening channel which extends along a direction transverse to the longitudinal dimension of the main bar, each end support being adapted to receive and rest on the upper end of a wall of the container;

each end support including a downwardly extending outer sidewall adapted to face the outer surface of the container wall, each end support further having means defining inner sidewall portions which extend downwardly from the top wall of the end support, the inner sidewall portions lying in a plane substantially parallel to that of the outer sidewall of the end support whereby the outer sidewall and inner sidewall portions of the end supports may embrace the outer and inner surfaces, respectively, of the container wall;

a plurality of barbs struck inwardly from the outer sidewall of each end support, said barbs including a central barb having an upwardly extending point and a pair of side barbs located on opposite sides of the central barb;

each of the side barbs having a substantially transversely extending upper edge and a downwardly and outwardly extending arcuate lower edge, the upper and lower edges of the side barbs meeting at a sharp point; and said central barb being adapted to resist upward movement of the end support on the container wall and the side barbs being adapted to resist lateral movement of the end supports on the container wall.

15. A garment hanger bar defined in claim 14 further comprising:

an additional pair of side barbs struck out from the outer sidewall of the end support, said additional pair of side barbs being symetrically disposed with respect to the center barb and defining an upwardly extending point adapted to engage the outer surface of the container wall.

* * * * *